United States Patent [19]

Marbacher

[11] Patent Number: 5,000,104

[45] Date of Patent: Mar. 19, 1991

[54] TRIMMING PRESSURE FOOT

[76] Inventor: Stephan Marbacher, Schmidgasse 2, CH-6300, Zug, Switzerland

[21] Appl. No.: 406,051

[22] Filed: Sep. 12, 1989

[30] Foreign Application Priority Data

Sep. 13, 1988 [CH] Switzerland ..... 03411/88

[51] Int. Cl.[5] ..... D05B 37/04

[52] U.S. Cl. ..... 112/128

[58] Field of Search ..... 112/122, 128, 129, 257

[56] References Cited

U.S. PATENT DOCUMENTS

| | | | |
|---|---|---|---|
| 202,908 | 4/1878 | Wilson | 112/128 |
| 322,326 | 7/1885 | Schoen | 112/128 X |
| 801,980 | 10/1905 | Glover | 112/128 |
| 947,506 | 1/1910 | Weinbach et al. | 112/128 |
| 1,727,850 | 9/1929 | Yates | 112/128 |

FOREIGN PATENT DOCUMENTS

| | | | |
|---|---|---|---|
| 1073215 | 9/1954 | France | 112/128 |
| 541650 | 3/1974 | Switzerland . | |

*Primary Examiner*—Werner H. Schroeder
*Assistant Examiner*—Paul C. Lewis
*Attorney, Agent, or Firm*—Thomas W. Speckman; Douglas H. Pauley

[57] ABSTRACT

A trimming pressure foot that can be interchangeably attached to a sewing machine includes one scissors blade fixedly attached to a pressure foot and one scissors blade pivotable about a shaft. The cutting motion is derived from the up-and-down motion of a needle drive rod. To this end, a pivot lever which is essentially in the shape of an inverted T is used. The pivot lever is pivotable about a shaft connected to the pressure foot, and its upwardly protruding arm rests with spring pressure on a needle securing screw. A flank of the arm resting on the screw forms an acute angle with the path of motion of the needle drive rod. In operation of the sewing machine, the up-and-down motion of the needle drive rod is converted into a pivoting motion of the pivot lever. The pivoting motion of the lever is transmitted onto the pivotable cutting blade by a tang secured to the pivot lever and by engaging the inside of a slit of the blade. The long needle drive rod stroke is thus elegantly and simply translated into a much shorter stroke of the trimming pressure foot.

12 Claims, 4 Drawing Sheets

FIG. 6
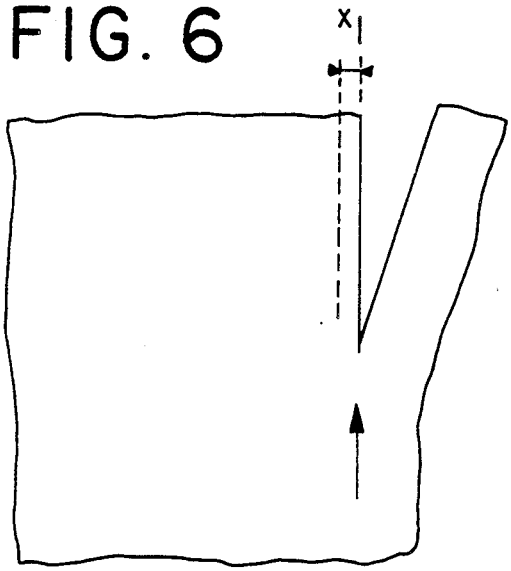
FIG. 7
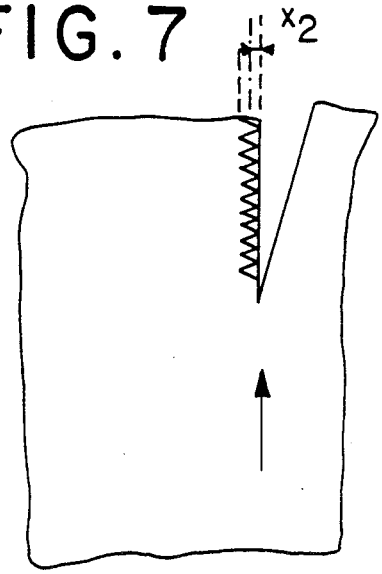
FIG. 8
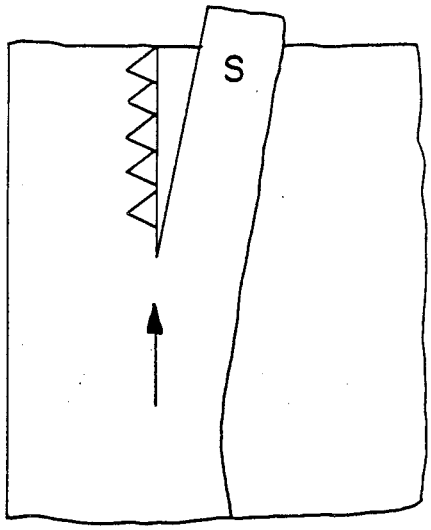
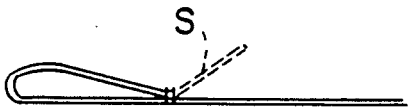
FIG. 9

TRIMMING PRESSURE FOOT

FIELD OF THE INVENTION

This invention relates to a trimming pressure foot that can be interchangeably attached to a sewing machine. With such type of pressure foot, the sewing machine can both sew a seam and trim the fabric alongside the seam, all in one operation.

BACKGROUND OF THE INVENTION

A similar trimming pressure foot is known from Swiss Patent 541,650. In principle, the scissors connected to the pressure foot are actuated by the up-and-down motion of the needle drive rod. With each stitch of the needle, the scissors cut a short distance in front of the stitching point, in the direction of fabric feed. The cutting distance must be short enough to allow the path of the cut to follow a curve; and it must also be longer than the maximum possible stitch length of the machine. However, the stroke of the needle drive rod is very much longer than the required stroke at the movable blade of the scissors.

To enable easy replacement of the trimming pressure foot, the motion is derived from a part already present on the needle drive rod, specifically the needle securing screw. The stroke of the movable blade of the scissors should be only approximately one-tenth of the stroke of the needle drive rod. The trimming pressure foot known from Swiss Patent 541,650 requires a double lever translation to accomplish this. This makes the construction relatively complicated, difficult to use, and expensive to manufacture.

OBJECT AND SUMMARY OF THE INVENTION

It is one object of the invention to create a trimming pressure foot that has a simplified structure and can be manufactured less expensively. The invention attains this object with a trimming pressure foot, interchangeably attached to a sewing machine, having scissors actuated by up-and-down motion of a needle drive rod. A pivot lever, that is connected to a movable cutting blade of the scissors, has an arm extending upward at least approximately vertically to a surface where the sewing is performed. The arm has a side flank that forms an acute angle with the path of motion of the needle drive rod, and during operation it rests with spring pressure against a needle securing screw.

BRIEF DESCRIPTION OF THE DRAWINGS

FIGS. 6–9 show various sewing operations that can be performed with the trimming pressure foot of this invention.

DESCRIPTION OF THE PREFERRED EMBODIMENT

Figure 1:
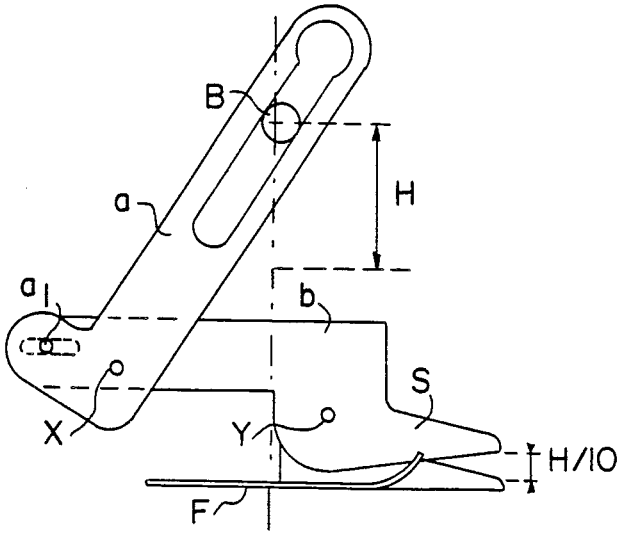
FIG. 1 PRIOR ART
FIG. 1 schematically shows the lever translation according to the prior art of Swiss Patent 541,650, and FIG. 2 schematically shows the trimming pressure foot of this invention.

In FIG. 1, the lever mechanism of Swiss Patent 541,650 is shown in simplified form. The needle securing screw B engages an oblong slit of the lever a, which is pivotable about a shaft X connected to the pressure foot F. A bolt $a_1$ of the lever a engages a slit of the second lever b, which is pivotable about the shaft Y which is secured to the pressure foot F. The shaft Y is also the pivot shaft of the movable scissors blade S. With the aid of the two levers a and b, the stroke H of the needle drive rod is reduced to H/10 at the scissors blade.

Figure 2:
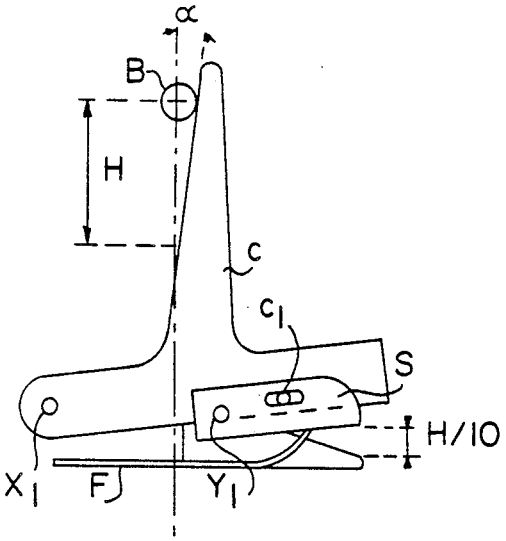

FIG. 2 shows the considerably simplified lever mechanism of the trimming pressure foot according to this invention. The pressure foot itself is again indicated by letter F. An approximately T-shaped pivot lever C is pivotable about the shaft Xl secured to the pressure foot. A bolt $c_1$ attached to the lever engages a slit of the movable scissors blade S. The blade is pivotable about the shaft Y which is secured to the pressure foot.

Because one flank of the upwardly extending arm of the lever C forms a small angle $\alpha$ with the path of motion of the needle drive rod, or with the path of motion of the needle securing screw B, the pivoting motion of the lever C is slight, and no further downward translation is necessary.

To provide that the flank of the pivot lever C will always rest on the screw B, a spring is attached, the spring is not shown in the drawing.

Figure 3:
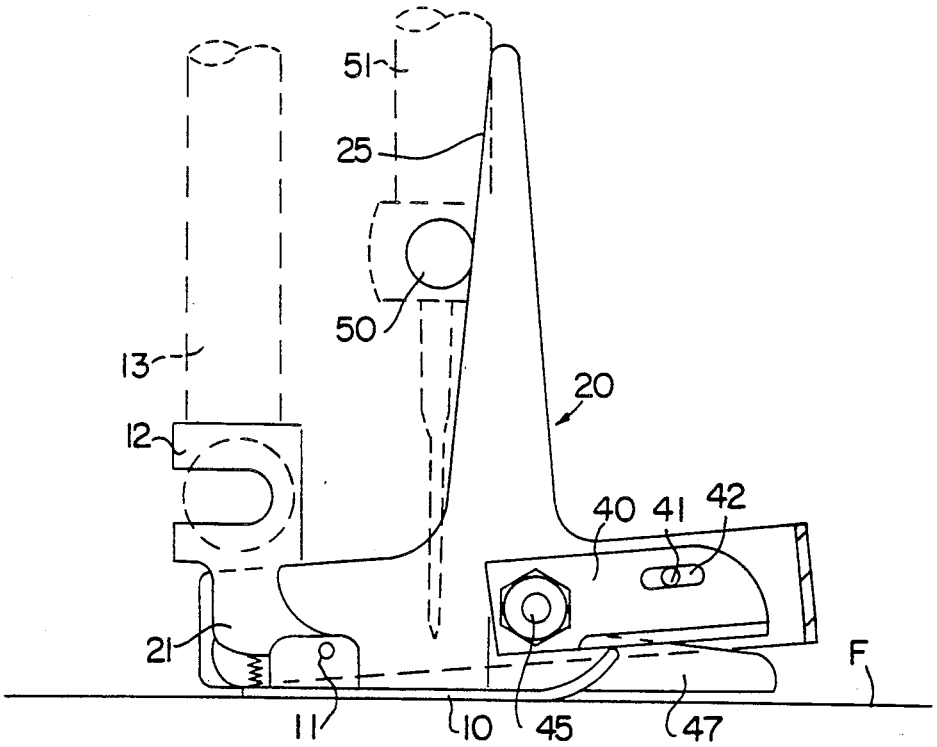
FIG. 3 is an enlarged side view of the trimming pressure foot according to this invention.
Figure 4:
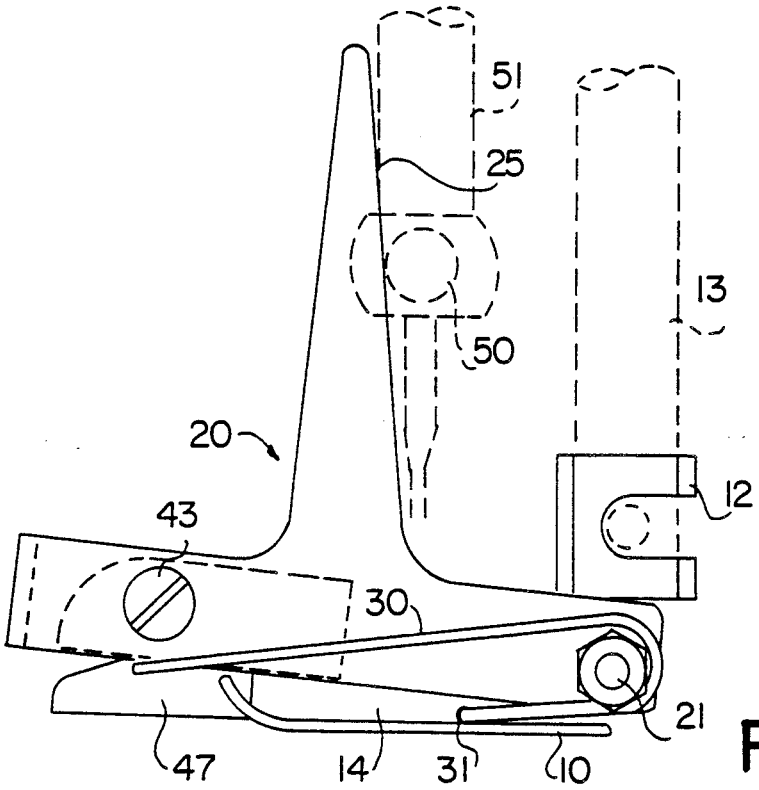
FIG. 4 is a rear view of the embodiment shown in FIG. 3.
Figure 5:
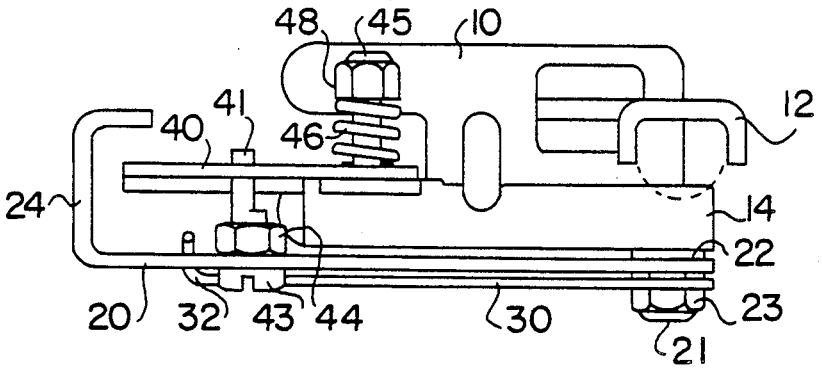
FIG. 5 is a view from the top of the trimming pressure foot shown in FIG. 4.

FIGS. 3–5 show one embodiment of a trimming pressure foot, in a larger scale than that of FIGS. 1 and 2. At 11, the pressure foot 10 is resiliently and pivotably connected to the holder 12 of the pressure foot guide rod 13. The guide rod is shown only with dashed lines, because it is not part of the invention.

Located on one side of the pressure foot is a bearing strip 14, as shown in FIG. 5, which supports the pivot bearings for the pivot lever 20 and for the pivotable scissors blade. The bearing strip 14 is secured to the pressure foot 10.

The T-shaped pivot lever 20 is pivotable about the shaft 21 which is secured to the strip 14. A spacer ring 22 and a nut 23 screwed onto the shaft 21 provide for guidance of the pivot lever 20. One arm of the lever is formed in a U-shape at the front end 24. This U-shape provides protection against unintentional touching of the scissors. The upwardly extending arm of the T-shaped pivot lever 20 has a flank 25 that in operation rests against the needle securing screw 50. In other words, during operation the needle securing screw 50 slides along the flank 25 and thereby provides a pivoting motion of the T-shaped pivot lever 20. The needle drive rod 51 is represented by dashed lines, because it is not part of this invention.

Figure 5A:
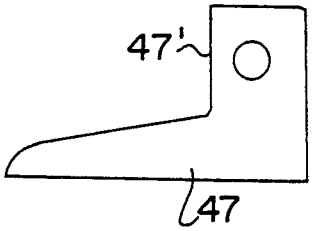

So that the flank 25 will continuously rest on the screw B, a spiral spring 30 is provided. One end of the spring 30, bent at a right angle, engages a bore 31 of the strip 14. The spring wraps around the nut 23, and the other end of the spring 30 extends under the front arm of the T-shaped pivot lever 20. To enable the T-shaped pivot lever 20 to actuate the movable blade 40 of the scissors, it is connected to a tang 41, which engages a slit 42 of the blade 40. The tang 41 is part of a screw 43 and is eccentrically mounted with respect to the screw 43. This makes the stroke of the scissors blade 40 adjustable. A setting, once selected, can be fixed by tightening a nut 44. The scissors blade 40 is pivotable about the shaft 45. A spring 46 provides for flush contact with the fixed scissors blade 47, and a nut 48 permits adjusting the contact pressure. The fixed scissors blade 47 is shown by itself in FIG. 5*a*. The upwardly extending portion 47' is retained in a groove in the strip 14. This makes both cutting blades easily replaceable.

Figure 4A:
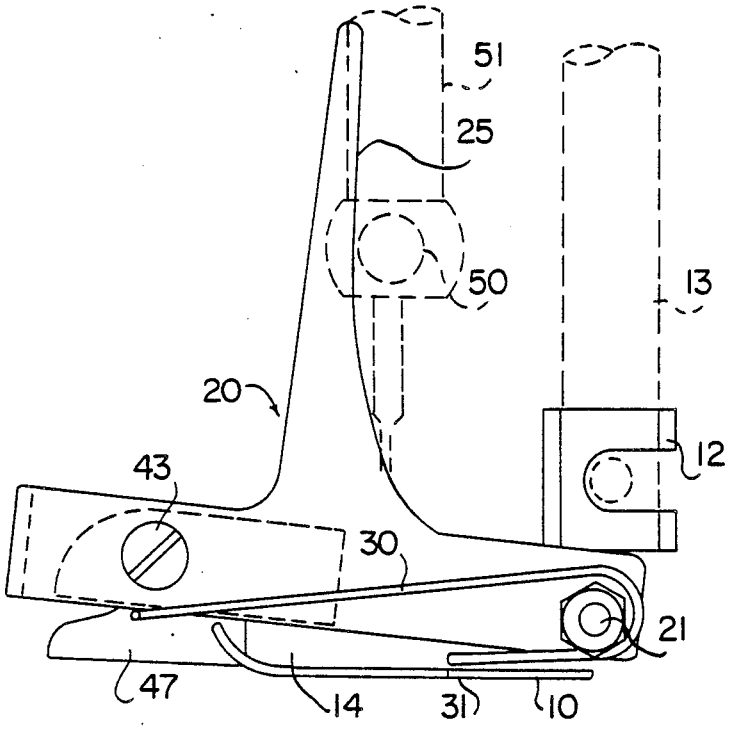
FIG. 4*a* is another embodiment of the rear view shown in FIG. 4.
Figure 4B:
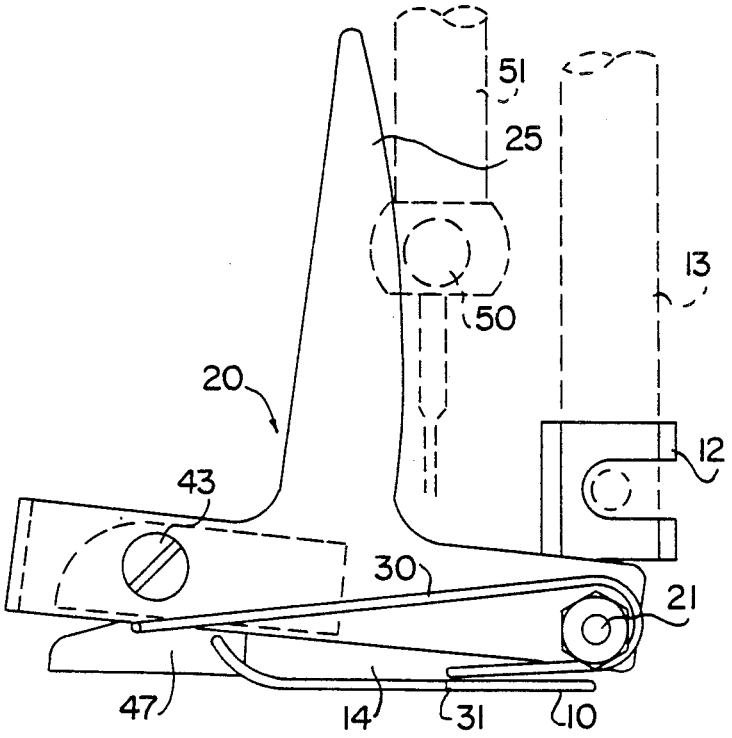
FIG. 4*b* is yet another embodiment of the rear view shown in FIG. 4.

In the embodiment shown, a straight flank 25 of the T-shaped pivot lever 20 arm is shown. This means that the cutting motion of the scissors continues during the entire stroke of the needle drive rod. However, the flank 25 can also be slightly curved as shown in FIGS. 4*a* and 4*b* so that as a result, the cutting motion can be shifted to either the beginning or the end of the stitching motion.

FIGS. 6–9 show examples of work done using a relatively modern sewing machine equipped with the trimming pressure foot according to this invention.

FIG. 6 shows a straight seam, alongside which the fabric is trimmed at a distance of $X_1$. The feed or entry direction is represented by the arrow shown in FIG. 6.

FIG. 7 shows an overlock or edge-finishing seam, with the zig-zag motion of the needle drive rod activated.

FIG. 8 shows a hemstitched seam in which only the upper layer of fabric is trimmed.

FIG. 9 shows a side view of the hemstitched seam, as shown in FIG. 8.

I claim:

1. A trimming pressure foot, interchangeably attachable to a sewing machine, having a scissors actuated by an up-and-down motion of a needle drive rod, the trimming pressure foot comprising: a pivot lever (20) connected to a movable cutting blade (40) of said scissors, said pivot lever 20 having an arm extending upward approximately vertically with respect to a surface (F) on which sewing is done, said arm having a side flank (25) forming an acute angle with a path of motion of a needle drive rod (51) and in operation rests by pressure with a spiral spring (30) against a needle securing screw (50), said side flank (25) remaining in constant contact with said needle securing screw (50).

2. A trimming pressure foot according to claim 1, wherein near the trimming pressure foot, a pivot shaft (45) of said cutting blade (40) is laterally offset in front of a needle stitching point, and a pivot shaft (21) of said pivot lever (20) is laterally offset behind said needle stitching point near a pressure foot guide rod (13).

3. A trimming pressure foot according to claim 1, wherein said spiral spring (30) is wrapped around a pivot shaft (21) of said pivot lever (20), and one end (31) of said spring (30) is connected to a fixed part (14) of the pressure foot (10), and an opposite end (32) of said spring (30) is connected to the pivot lever (20).

4. A trimming pressure foot according to claim 1, wherein the movable cutting blade (40) of the scissors has a slit (42) which is engaged by a tang (41) connected to said pivot lever (20).

5. A trimming pressure foot according to claim 4, wherein said tang (41) is disposed eccentrically on securing means (43, 44) that is secured and rotatable with respect to said pivot lever (20).

6. A trimming pressure foot according to claim 1, wherein said side flank (25) of said pivot lever (20) resting on said needle securing screw (50) during operation is straight.

7. A trimming pressure foot according to claim 1, wherein said side flank (25) of said pivot lever (20) rests on a needle securing screw (B) during operation and is curved along a portion of a length of said side flank (25).

8. A trimming pressure foot, interchangeably attachable to a sewing machine, having a scissors actuated by an up-and-down motion of a needle drive rod, the trimming pressure foot comprising: a pivot lever (200 connected to a movable cutting blade (40) of said scissors, said pivot lever (20) having an arm extending upward approximately vertically with respect to a surface 9*f*) on which sewing is done, said arm having a side flank (25) forming an acute angle with a path of motion of a needle drive rod (51) and in operation rests by pressure with a spiral spring (30) against a needle securing screw (5), said side flank (25) of said pivot lever (20) resign on said needle securing screw (50) during operation being straight.

9. A trimming pressure foot according to claim 8, wherein near the trimming pressure foot, a pivot shaft (45) of said cutting blade (40) is laterally offset in front of a needle stitching point, and a pivot shaft (21) of said pivot lever (20) is laterally offset behind said needle stitching point near a pressure foot guide rod (13).

10. A trimming pressure foot according to claim 8, wherein said spiral spring(3) is wrapped around a pivot shaft (21) of said pivot lever (20), and one end (31) of said spring (30) is connected to a fixed part (14) of the pressure foot (10), and an opposite end (32) of said spring (30) is connected to the pivot lever (20).

11. A trimming pressure foot according to claim 8, wherein the movable cutting blade (40) of the scissors has a slit (42) which is engaged by a tang (41) connected to said pivot lever (20).

12. A trimming pressure foot according to claim 11, wherein sad tang (41) is disposed eccentrically on securing means (43, 44) that is secured and rotatable with respect to said pivot lever (20).

* * * * *